US009290359B2

(12) United States Patent
Armistead et al.

(10) Patent No.: US 9,290,359 B2
(45) Date of Patent: Mar. 22, 2016

(54) TIMER-BASED CONTROL OF FIXTURE CHANNELS

(75) Inventors: Jason R. Armistead, Avon, CT (US); James M. Collins, Burlington, CT (US); Dang V. Nguyen, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 659 days.

(21) Appl. No.: 13/701,091

(22) PCT Filed: Jul. 27, 2010

(86) PCT No.: PCT/US2010/043380

§ 371 (c)(1),
(2), (4) Date: Nov. 30, 2012

(87) PCT Pub. No.: WO2012/015394

PCT Pub. Date: Feb. 2, 2012

(65) Prior Publication Data

US 2013/0068567 A1 Mar. 21, 2013

(51) Int. Cl.

| | |
|---|---|
| ***B66B 1/28*** | (2006.01) |
| ***B66B 1/34*** | (2006.01) |
| ***B66B 1/46*** | (2006.01) |

(52) U.S. Cl.

CPC . *B66B 1/34* (2013.01); *B66B 1/468* (2013.01); *B66B 1/3453* (2013.01)

(58) Field of Classification Search

CPC ..... B66B 1/34; B66B 1/468; B66B 1/3453
USPC ..... 187/247, 248, 391, 393
See application file for complete search history.

(56) References Cited

U.S. PATENT DOCUMENTS

| | | | | | |
|---|---|---|---|---|---|
| 4,765,442 | A | * | 8/1988 | Blain et al. | 187/247 |
| 5,202,540 | A | * | 4/1993 | Auer et al. | 187/247 |
| 5,502,818 | A | * | 3/1996 | Lamberg | 709/225 |
| 5,654,531 | A | * | 8/1997 | Farabee et al. | 187/247 |

(Continued)

FOREIGN PATENT DOCUMENTS

| | | | |
|---|---|---|---|
| CN | 1244490 | A | 2/2000 |
| CN | 1562720 | A | 1/2005 |

(Continued)

OTHER PUBLICATIONS

International Search Report for International Application No PCT/US2010/043380; filing date: Jul. 27, 2010; Applicant: Otis Elevator Company et al.,; mailing date Apr. 27, 2011, 3 pages.

(Continued)

*Primary Examiner* — Anthony Salata
(74) *Attorney, Agent, or Firm* — Cantor Colburn LLP

(57) ABSTRACT

A method for controlling a fixture (122) includes receiving a message from a controller (102), determining whether the message includes an address associated with the fixture (122), retrieving an identifier of the controller (102) from the message responsive to determining that the message includes an address not associated with the fixture (122), determining whether the fixture (122) includes a fixture channel (204) controlled by the controller (102), and resetting a timer (203) associated with the fixture channel (204) controlled by the controller (102) responsive to determining that the fixture (122) includes the fixture channel (204) controlled by the controller (102).

17 Claims, 4 Drawing Sheets

(56) References Cited

U.S. PATENT DOCUMENTS

| | | | | | |
|---|---|---|---|---|---|
| 5,884,729 | A * | 3/1999 | Park et al. | 187/248 |
| 5,892,189 | A * | 4/1999 | Wang | 187/247 |
| 6,003,637 | A * | 12/1999 | Kim et al. | 187/391 |
| 6,269,912 | B1 | 8/2001 | Kim | |
| 6,427,808 | B1 * | 8/2002 | Mori et al. | 187/391 |
| 6,467,583 | B1 * | 10/2002 | Koura et al. | 187/247 |
| 6,471,011 | B1 * | 10/2002 | Ando et al. | 187/247 |
| 6,672,429 | B1 * | 1/2004 | Thurmond, III | 187/247 |
| 8,177,031 | B2 * | 5/2012 | Flynn et al. | 187/247 |
| 8,573,364 | B2 * | 11/2013 | Fang et al. | 187/247 |

FOREIGN PATENT DOCUMENTS

| | | | |
|---|---|---|---|
| CN | 201151593 | Y | 11/2008 |
| JP | 03003872 | | 1/1991 |
| JP | 06286966 | | 10/1994 |
| JP | 2000095454 | | 4/2000 |
| JP | 2001-097646 | | 4/2001 |
| KR | 2000-0061619 | | 10/2000 |
| WO | 2012015394 | A1 | 2/2012 |

OTHER PUBLICATIONS

English Abstract for JP Publication No. 03-003872; Date of Publication: Jan. 9, 1991; Applicant: Mitsubishi Electric Corp; 1 page.

English Abstract for JP Publication No. 06-286966; Date of Publication: Oct. 11, 1994; Applicant: Mitsubishi Denki Bill Techno Service KK; 1 page.

English Abstract for JP Publication No. 2001-097646; Date of Publication: Apr. 10, 2001; Applicant: Toshiba Corp; 1 page.

English Abstract for Korean Patent Publication no. 1020000061619A; Date of Publication Oct. 25, 2000, Applicant: LG Otis Elevator Company; 1 page.

Written Opinion for International Patent Application PCT/US2010/043380; International Filing Date: Jul. 27, 2010; Applicant: Otis Elevator Company et al.,; Mailing Date: Apr. 27, 2011; 3 pages.

Chinese Search Report for application CN201080068284.8, issued Feb. 28, 2014, 3 pages.

First Chinese Office Action (translation), for application CN No. 201080068284.8, issued Mar. 11, 2014, 11 pages.

Second Chinese Office Action (translation), for CN application No. 201080068284.8, issued Oct. 15, 2014, 14 pages.

PCT International Preliminary Report on Patentability and Written Opinion of the International Searching Authority for International Application No. PCT/US2010/043380, Feb. 7, 2013, 5 pages.

* cited by examiner

TIMER-BASED CONTROL OF FIXTURE CHANNELS

CROSS-REFERENCE TO RELATED APPLICATIONS

This application is a U.S. national phase application filed pursuant to 35 U.S.C. 371 and claims benefit of PCT Patent Application No. PCT/US2010/043380; filed Jul. 27, 2010 and assigned International Publication No. WO2012/015394A1, published Feb. 2, 2012.

BACKGROUND

The present invention relates to elevator and escalator systems, and more specifically, to methods and systems for controlling elevator and escalator systems.

Elevator systems, for example, may include a plurality of elevator cars that service a number of floors in a structure. Each elevator car includes associated controllers or processors that may control the system. The system includes fixtures such as push buttons, visual indicators and audio indicators that may be located on each floor, in an elevator car, in a controller, and in a central location such as a machinery room or control room. Previous systems connected each fixture to the controllers independently using cables dedicated to each fixture or group of fixtures.

SUMMARY

According to one embodiment of the present invention, a method for controlling a fixture includes receiving a message from a controller, determining whether the message includes an address associated with the fixture, retrieving an identifier of the controller from the message responsive to determining that the message includes an address not associated with the fixture, determining whether the fixture includes a fixture channel controlled by the controller, and resetting a timer associated with the fixture channel controlled by the controller responsive to determining that the fixture includes the fixture channel controlled by the controller.

According to another embodiment of the present invention a fixture device includes a fixture channel operative to output a signal, a timer associated with the fixture channel, and a processor operative to receive a message from a controller, determine whether the message includes an address associated with the fixture, retrieve an identifier of the controller from the message responsive to determining that the message includes an address not associated with the fixture, determine whether the fixture includes a fixture channel controlled by the controller, and reset a timer associated with the fixture channel controlled by the controller responsive to determining that the fixture includes the fixture channel controlled by the controller.

According to yet another embodiment of the present invention a control system includes a controller; and a fixture communicatively connected to the controller, the fixture including a fixture channel operative to output a signal, a timer associated with the fixture channel, and a processor operative to receive a message from the controller, determine whether the message includes an address associated with the fixture, retrieve an identifier of the controller from the message responsive to determining that the message includes an address not associated with the fixture, determine whether the fixture includes a fixture channel controlled by the controller, and reset a timer associated with the fixture channel controlled by the controller responsive to determining that the fixture includes the fixture channel controlled by the controller.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
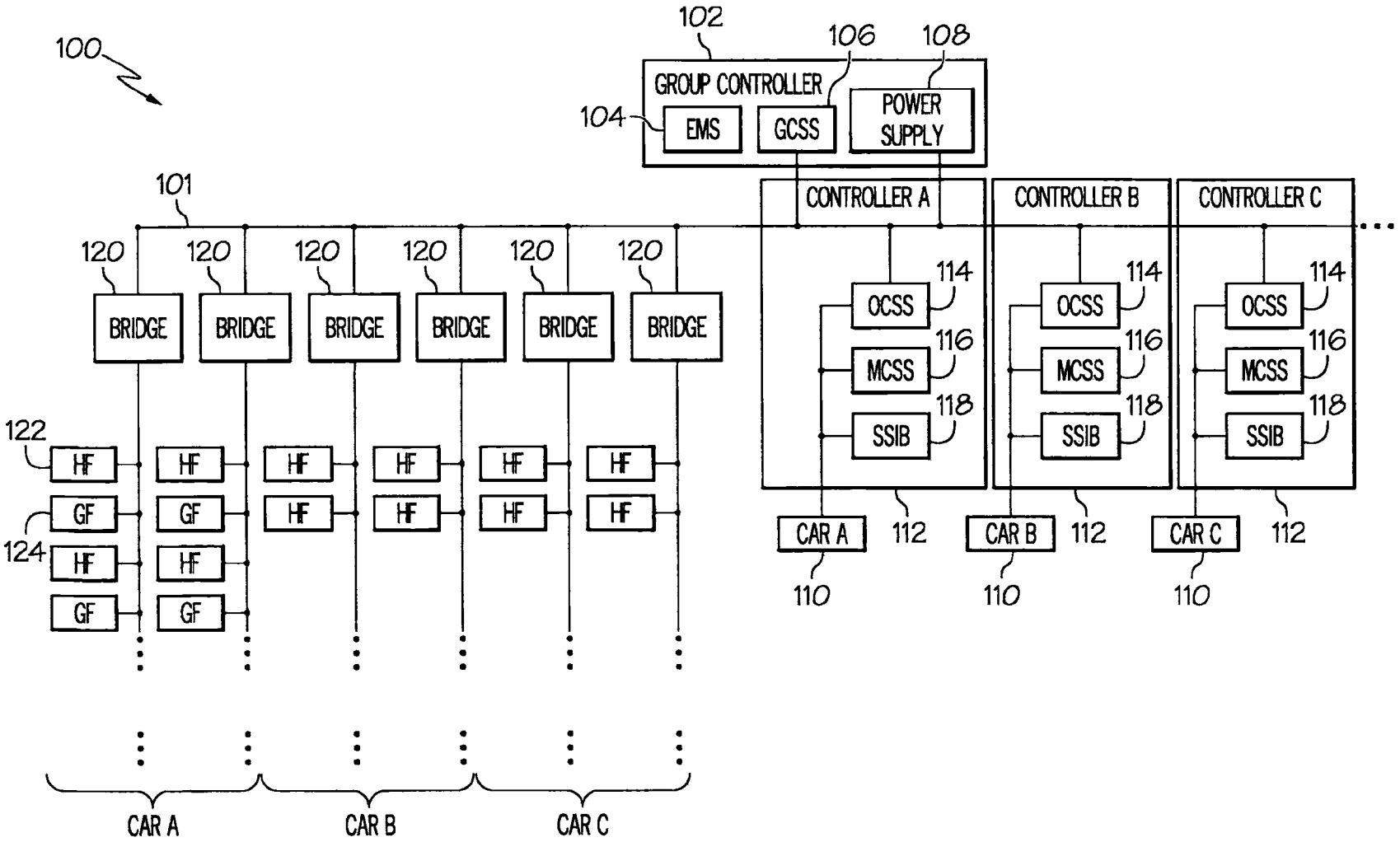
FIG. 1 illustrates an exemplary embodiment of an elevator system.

FIG. 1 illustrates and exemplary embodiment of an elevator system 100. The system 100 includes a group controller 102 that includes processors such as, for example, an elevator management system (EMS) 104 that may be used to monitor and/or control the system, a group control sub-system (GCSS) 106 that may control dispatching and a power supply 108. The group controller 102 is communicatively connected to a bus 101. In the illustrated embodiment, the system 100 includes three cars 110, however other embodiments may include any number of cars 110 and associated hardware. Car controllers 112 are associated with each car 110 and are communicatively connected to the bus 101 and the associated car 110. The car controllers 112 may include processors such as, for example, an operational control sub-system (OCSS) 114 that may perform car logic functions, a motion control sub system (MCSS) 116 that controls the motion of the cars 110, and a safety system interface board (SSIB) 118. A plurality of bridges 120 may be connected to the bus 101. A plurality of fixtures such as, hall fixtures (HF) 122 and group fixtures (GF) 124 are connected to the bus 101 via the bridges 120 and are associated with the cars 110. Hall fixtures 122 may include, for example, visual indicators such as lights or lanterns, audio indicators such as gongs or bells, and car position indicators. Group fixtures 124 may include, for example, buttons such as up and down buttons that may include visual indicators such as lights. Group fixtures 124 may also include, for example, keypad type input devices. Other similar fixtures may be located in the cars 110 and may operate in a similar manner.

Figure 2:
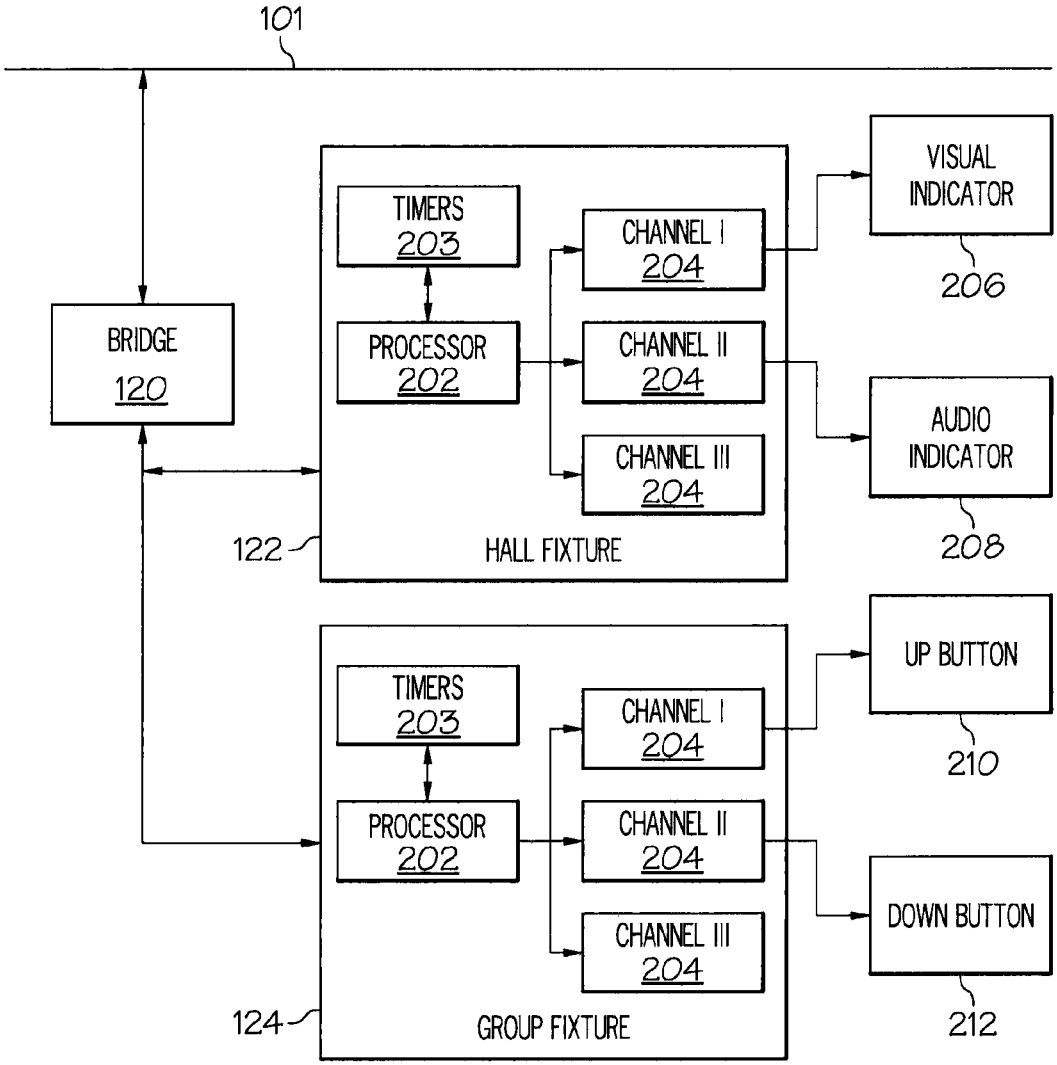
FIG. 2 illustrates an exemplary embodiment of fixtures of FIG. 1.

FIG. 2 illustrates an exemplary embodiment of fixtures 122 and 124. The fixtures 122 and 124 are similar, and include processors 202 that are operative to receive and send signals to the car controllers 112 and the group controller 102 (of FIG. 1) via the bridge 120 and the bus 101. Each of the fixtures 122 and 124 is assigned a unique identifier. The fixtures 122 and 124 include channels 204 that are assigned to logically control particular functions in the fixture. For example, the hall fixture 122 may include a visual indicator 206 connected to the channel I 204 and an audio indicator 208 connected to the channel II 204, while the group fixture 124 may include an up button 210 connected to the channel I 204 (of the group fixture 124) and a down button 212 connected to the channel II 204 (of the group fixture 124). The processor 202 includes timers 203 that are associated with each channel 204.

In operation, a car controller 112 is designated as a master controller, for illustrative purposes, in this example, the car controller A 112 is initially the master controller. Any of the car controllers 112 may be designated as the master controller, and may transfer master control duties at any time, such as, for example, when a particular car 110 is removed from service. When a user presses the up button 210 in group fixture 124 to call a car 110, the actuated group fixture 124 processes the button press and sends a message to the car controller A 112 via the bus 101. The message includes the unique indicator of the group fixture 124 (fixture address) and data that notifies the car controller A 112 that the up button 210 has been actuated (i.e., that a channel, in this case the button, has changed states). The car controller A 112 may dispatch a car 110 to the floor associated with the group fixture 124. When the car 110 arrives at the floor, the car controller A 112 may send a message that includes the unique identifier of the car controller A 112 (the controller address), the unique identifier of the hall fixture 122 on the floor (the fixture address), an indication that a state will change in a channel of the hall fixture 122 (a state change notification), and an instruction to change the state of the channel (a channel state instruction). In the illustrated example, the message may include an instruction to change the state of the audio indicator 208 (gong) and visual indicator 206 (lantern) channels 204 to sound the gong and light the lantern, thus notifying a user that the car has arrived. In the above example, the instructions to change the state of the channel may include binary signals that toggle an indicator on or off, or data that includes a position of a car 110 such as, for example, a floor number that may be displayed by a fixture.

In the example discussed above, the car controller A 112 has been designated as the master controller, and the fixtures 122 and 124 perform logic that assigns control of each channel 204 to a particular controller. However, if the master controller changes, such as when the controller is removed from service for maintenance, it is desirable to update the control assignments of the channels.

Figure 3:
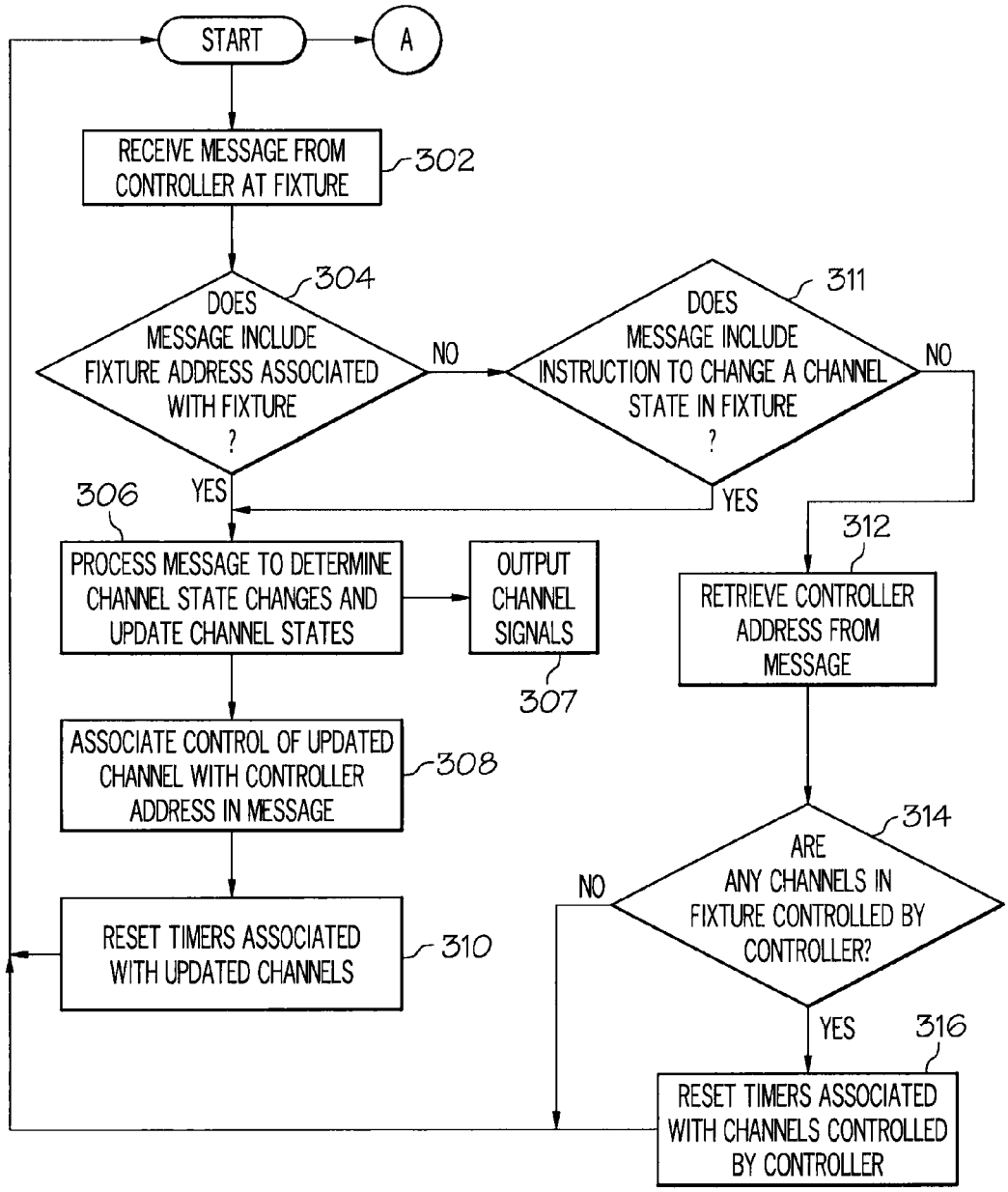
FIGS. 3 and 4 illustrate block diagrams of exemplary methods for controlling the system of claim 1.
Figure 4:
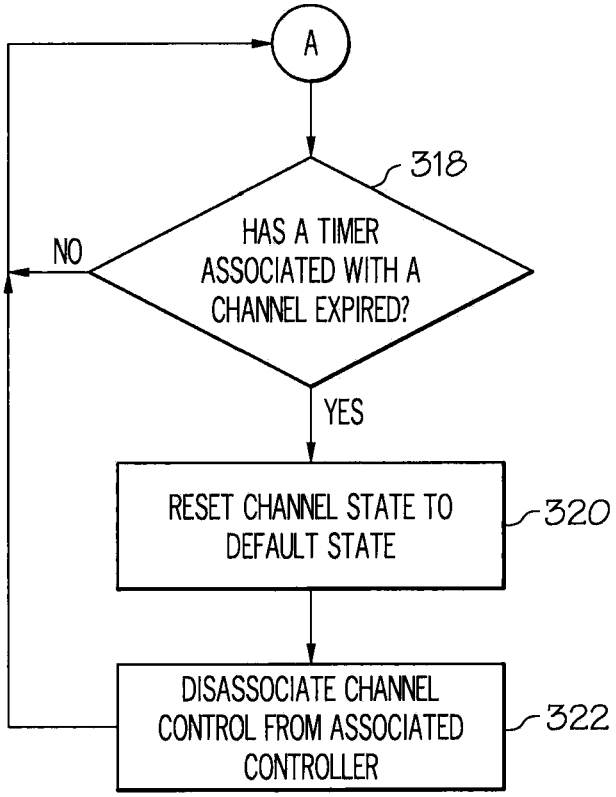

FIGS. 3 and 4 illustrate block diagrams of exemplary logic embodiments for assigning channel control in the fixtures 122 and 124 (of FIG. 1). In this regard, referring to FIG. 3, a message from a controller 112 is received by a fixture 122 (or 124) in block 302. In block 304, the fixture 122 determines whether the message includes the fixture address associated with the receiving fixture 122. If the message includes the fixture address associated with the receiving fixture, the message is processed to determine if the message includes a channel state change in a channel 204 (of FIG. 2) of the fixture 122. If the message includes a channel state change, in block 307, the processor 202 in the fixture 122 outputs the channel state change to the device associated (or connected) to the channel 204 (i.e., updates the channel state). In block 308, the processor 202 associates control of the updated channel with the controller 112 that sent the message. In block 310 the timers 203 that are associated with the updated channels 204 are reset.

If in block 304, the fixture 122 determines that the message does not include the fixture address associated with the receiving fixture 122, the fixture determines whether the message includes an instruction to change a state of a channel in block 311. For example, a position indicator fixture (or a number of position indicator fixtures) may receive a message indicating that the position indicator(s) should display a particular visual indication. The position indicator fixtures may process the message to determine and process a channel state change without the message being addressed to a particular fixture. If the message includes an instruction to change a state of a channel in the fixture, the message is processed in block 306 in a similar manner as discussed above. If the message does not include an instruction to change a state of a channel in the fixture, the controller address (of the sending controller 112) is retrieved from the message in block 312. In block 314, the processor 202 determines whether any of the channels 204 in the fixture 122 are assigned to the controller 112 that sent the message. If a channel 204 is assigned to the controller 112 that sent the message, the timer 203 associated with the channel 204 is reset in block 316. In a similar manner, the controller may output periodic messages that do not cause the timers 203 to reset. In this regard, an example message that does not include the fixture address, and is not already associated with a channel of that fixture will not cause the timers 203 to reset.

Referring to FIG. 4, if a timer associated with a channel has expired in block 318, the channel state of the associated channel 204 is reset to a default state by the processor 202 in block 320. In block 322, the channel control is disassociated (or unassigned) from the assigned controller 112. For example, if a controller 112 is removed from service, the controller 112 will not send messages, and the timers 203 associated with channels 204 that are assigned to the controller 112 will expire. Once expired, the channels will be reset (e.g., audio indicating channels may be set to a default off state), and channel control will be disassociated from the out of service controller 112.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A method for controlling a fixture, the method comprising:

receiving a message from a controller;

determining whether the message includes an address associated with the fixture;

when the message includes an address associated with the fixture, then processing the message to determine a channel state change, updating a fixture channel in response to the channel state change, associating control of the updated fixture channel with a controller address in the message and resetting timers associated with the updated fixture channel;

when the message does not include an address associated with the fixture and the message does not include an instruction to change a state of a fixture channel, then retrieving a controller address from the message and resetting timers associated with any channels in the fixture that are controlled by a controller associated with the controller address.

2. The method of claim 1, wherein the method further includes:

determining whether the timer associated with the fixture channel has expired; and setting a channel state to a default state responsive to determining that the timer associated with the fixture channel has expired.

3. The method of claim 2, wherein the method further includes disassociating the controller previously associated with the fixture channel from the fixture channel.

4. The method of claim 1, wherein the method further includes outputting a signal operative to actuate an indicator device responsive to changing the state of the fixture channel.

5. The method of claim 1, wherein the controller is operative to control an elevator car.

6. A fixture device including:

a fixture channel operative to output a signal;

a timer associated with the fixture channel; and a processor operative to receive a message from a controller and determine whether the message includes an address associated with the fixture;

when the message includes an address associated with the fixture, then the processor processing the message to determine a channel state change, updating a fixture channel in response to the channel state change, associating control of the updated fixture channel with a controller address in the message and resetting timers associated with the updated fixture channel;

when the message does not include an address associated with the fixture and the message does not include an instruction to change a state of a fixture channel, then the processor retrieving a controller address from the message and resetting timers associated with any channels in the fixture that are controlled by a controller associated with the controller address.

7. The device of claim 6, wherein the processor is further operative to determine whether the timer associated with the fixture channel has expired, and set the channel state to a default state responsive to determining that the timer associated with the fixture channel has expired.

8. The device of claim 7, wherein the processor is further operative to disassociate the controller previously associated with the fixture channel from the fixture channel.

9. The device of claim 6, wherein the processor is further operative to output a signal operative to actuate an indicator device responsive to changing the state of the fixture channel.

10. The device of claim 6, wherein the controller is operative to control an elevator car.

11. A control system including:

a controller; and a fixture communicatively connected to the controller, the fixture including:

a fixture channel operative to output a signal;

a timer associated with the fixture channel; and a processor operative to receive a message from the controller and determine whether the message includes an address associated with the fixture;

when the message includes an address associated with the fixture, then the processor processing the message to determine a channel state change, updating a fixture channel in response to the channel state change, associating control of the updated fixture channel with a controller address in the message and resetting timers associated with the updated fixture channel;

when the message does not include an address associated with the fixture and the message does not include an instruction to change a state of a fixture channel, then the processor retrieving a controller address from the message and resetting timers associated with any channels in the fixture that are controlled by a controller associated with the controller address.

12. The system of claim 11, wherein the processor is further operative to determine whether the timer associated with the fixture channel has expired, and set the channel state to a default state responsive to determining that the timer associated with the fixture channel has expired.

13. The system of claim 12, wherein the processor is further operative to disassociate the controller previously associated with the fixture channel from the fixture channel.

14. The system of claim 11, wherein the processor is further operative to output a signal operative to actuate an indicator device responsive to changing the state of the fixture channel.

15. The system of claim 11, wherein the controller is operative to control an elevator car.

16. The system of claim 11, wherein the system includes a bus communicatively connecting the controller to the fixture.

17. The system of claim 11, wherein the controller is associated with a unique identifying address and the fixture is associated with a unique identifier address.

* * * * *